US008348381B2

(12) United States Patent
Nakano et al.

(10) Patent No.: US 8,348,381 B2
(45) Date of Patent: Jan. 8, 2013

(54) RECORDING APPARATUS

(75) Inventors: Yosuke Nakano, Shiojiri (JP); Tomoya Takikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 324 days.

(21) Appl. No.: 12/754,679

(22) Filed: Apr. 6, 2010

(65) Prior Publication Data

US 2010/0253723 A1 Oct. 7, 2010

(30) Foreign Application Priority Data

Apr. 7, 2009 (JP) ..... 2009-093029

(51) Int. Cl.
*B41J 2/165* (2006.01)

(52) U.S. Cl. ..... 347/32; 347/20

(58) Field of Classification Search ..... 347/20, 347/32

See application file for complete search history.

(56) References Cited

U.S. PATENT DOCUMENTS

| | | | | |
|---|---|---|---|---|
| 7,934,789 | B2 * | 5/2011 | Silverbrook | 347/20 |
| 8,109,598 | B2 * | 2/2012 | Samoto et al. | 347/32 |
| 2007/0076036 | A1 * | 4/2007 | Koga et al. | 347/16 |

FOREIGN PATENT DOCUMENTS

| | | |
|---|---|---|
| JP | 06-087242 | 3/1994 |

* cited by examiner

*Primary Examiner* — Julian Huffman
*Assistant Examiner* — Sharon A Polk
(74) *Attorney, Agent, or Firm* — Workman Nydegger

(57) ABSTRACT

The driving force transmission changeover mechanism has a changeover operation mode in which a state of transmission of the driving force changes and a maintenance operation mode in which the state of transmission of the driving force is maintained, the changeover operation mode being executed when the carriage moves from the dot formation area to a first changeover position within the recording head maintenance area and then to the dot formation area, and the maintenance operation mode being executed when the carriage moves from the dot formation area to a second changeover position within the recording head maintenance area and then to the dot formation area.

2 Claims, 10 Drawing Sheets

RECORDING APPARATUS

BACKGROUND

1. Technical Field

The present invention relates to a recording apparatus having a carriage that is supported reciprocatingly movably in a predetermined direction and mounted with a recording head forming a dot on a recording surface of a recording material.

2. Related Art

A well-known recording apparatus having a driving force transmission changeover mechanism that can change between a state in which a driving force of a driving force source is transmitted to a driven mechanism and a state in which the driving force is not transmitted to the driven mechanism, uses a carriage for effecting a changeover operation for the driving force transmission changeover mechanism. For example, a known printer enables changeover of a paper feeding mechanism by using a carriage that pushes for example, a lever to operate a clutch mechanism (see, for example, JP-A-6-87242). The driving force transmission changeover mechanism such as that using the carriage as described above eliminates the need for a motor dedicated to operating the driving force transmission changeover mechanism. This achieves further reduction in cost of recording apparatuses having the driving force transmission changeover mechanisms.

In such a known recording apparatus having the driving force transmission changeover mechanism that uses the carriage, typically, the driving force transmission changeover mechanism is disposed adjacent to a dot formation area (an area in which dots are formed on the recording surface of the recording material) of a recording head in a reciprocating direction of the carriage. Further, the carriage is provided with an extended movable range so as to be movable outside the dot formation area. In such a recording apparatus, the carriage movement to the extended area outside the dot formation area will cause the carriage and the driving force transmission changeover mechanism to be engaged with each other, and then a changeover operation of driving force transmission can be performed (see, for example, JP-A-6-87242).

A recording apparatus in which a maintenance operation for the recording head, such as a so-called flushing operation or wiping operation, is performed at the intervals between dot formation control sequences, includes a recording head maintenance area disposed outside the dot formation area. Consequently, such a recording apparatus has required in the past that the driving force transmission changeover mechanism be disposed further outside the recording head maintenance area that is disposed outside the dot formation area. It has also been necessary to extend the movable range of the carriage so that the carriage can move further outside the recording head maintenance area disposed outside the dot formation area.

As described above, the known recording apparatus has the movable range of the carriage extended further outside a moving range of the carriage (the dot formation area and the recording head maintenance area) required for executing recording on a recording material and the carriage and the driving force transmission changeover mechanism are configured to engage with each other in that extended area. Specifically, in the known recording apparatus, an area over which the carriage moves during recording control is completely isolated from an area in which a changeover operation for the driving force transmission changeover mechanism is performed using the carriage, so that the two areas do not overlap each other. The known recording apparatus therefore has a merit that the recording control through a reciprocating motion of the carriage does not interfere with the changeover control for the driving force transmission changeover mechanism using the carriage.

The known recording apparatus, however, has the driving force transmission changeover mechanism disposed outside the moving range of the carriage required for executing the recording on the recording material. This arrangement accordingly requires that the movable range of the carriage be extended further outside the moving range of the carriage required for executing the recording on the recording material. As a result, in the known recording apparatus, the movable range of the carriage is elongated by at least an extended portion of the movable range of the carriage, which poses a problem in that the recording apparatus becomes large in size.

SUMMARY

An advantage of some aspects of the invention is to reduce likelihood that, in a recording apparatus having a driving force transmission changeover mechanism using a carriage, the recording apparatus will become larger in size.

According to a first aspect of the invention, a recording apparatus includes a carriage that is supported reciprocatingly movably in a predetermined direction and mounted with a recording head for forming a dot on a recording surface of a recording material, and a driving force transmission changeover mechanism that can change between a state in which a driving force of a driving force source is transmitted to a driven mechanism and a state in which the driving force is not transmitted to the driven mechanism by making the carriage engage therewith. The reciprocatingly movable range of the carriage includes a dot formation area in which a dot is formed on the recording surface of the recording material by the recording head and a recording head maintenance area which is disposed adjacent to the dot formation area and in which a maintenance operation of the recording head is performed. The driving force transmission changeover mechanism has a changeover operation mode in which a state of transmission of the driving force changes and a maintenance operation mode in which the state of transmission of the driving force is maintained, the changeover operation mode being executed when the carriage moves from the dot formation area to a first changeover position within the recording head maintenance area and then to the dot formation area, and the maintenance operation mode being executed when the carriage moves from the dot formation area to a second changeover position within the recording head maintenance area and then to the dot formation area.

Disposing the driving force transmission changeover mechanism in an area near a boundary between the dot formation area and the recording head maintenance area permits reduction in size of the recording apparatus as compared with the known ones. On the other hand, incorporating the arrangement in which the carriage and the driving force transmission changeover mechanism engage at a position near the boundary between the dot formation area and the recording head maintenance area, involves a temporary movement of the carriage from the dot formation area to the recording head maintenance area at a timing of the maintenance operation of the recording head performed at the intervals between dot formation control sequences. This gives rise to a likelihood that unnecessary drive ON/OFF changeovers will occur at this time.

To avoid occurrence of such unnecessary drive ON/OFF changeovers during execution of recording, the driving force transmission changeover mechanism according to the first aspect of the invention has the maintenance operation mode.

By setting the position at which the carriage turns around to a first changeover position or a second changeover position, either one of the operation modes, specifically, the changeover operation mode or the maintenance operation mode, can be selected.

According to the maintenance operation mode, even if the driving force transmission changeover mechanism is operated by the movement of the carriage, the state of transmission of the driving force before the stated operation can be maintained. Occurrence of unnecessary drive ON/OFF changeovers in the driving force transmission changeover mechanism can therefore be avoided during execution of recording. For example, to perform a so-called flushing operation, wiping operation, or other recording head maintenance operation at the intervals between dot formation control sequences, the carriage is to be first moved from the dot formation area to the second changeover position within the recording head maintenance area and then to the dot formation area. Even if the carriage engages with the driving force transmission changeover mechanism, the state of transmission of the driving force remains unchanged before and after the engagement (maintenance operation mode). Occurrence of unnecessary drive ON/OFF changeovers in the driving force transmission changeover mechanism can therefore be avoided when the recording head is temporarily moved to the recording head maintenance area in order to perform the flushing operation, wiping operation, or similar operation during execution of the recording.

According to the first aspect of the invention, an effect can be achieved of reducing likelihood that, in the recording apparatus having the driving force transmission changeover mechanism that uses the carriage, the recording apparatus will become larger in size.

According to a second aspect of the invention, in the recording apparatus of the above-described first aspect of the invention, the changeover operation mode is a mode in which the state of the driving force of the driving force source not being transmitted to the driven mechanism is changed to the state of the driving force being transmitted to the driven mechanism and the maintenance operation mode is a mode in which the state of the driving force of the driving force source not being transmitted to the driven mechanism is maintained.

According to the second aspect of the invention, in the maintenance operation mode, even if the driving force transmission changeover mechanism is operated by the movement of the carriage, the state of the driving force of the driving force source not being transmitted to the driven mechanism can be maintained before and after the operation of the driving force transmission changeover mechanism. For example, even if the maintenance operation of the recording head is performed at the intervals between recording sequences, a state of a feed unit or the like not being operated by the driving force of the driving force source can be maintained before and after the operation.

According to a third aspect of the invention, a recording apparatus includes a carriage and a driving force transmission changeover mechanism. Specifically, the carriage is supported reciprocatingly movably in a predetermined direction and mounted with a recording head for forming a dot on a recording surface of a recording material. The driving force transmission changeover mechanism can change between a state in which a driving force of a driving force source is transmitted to a driven mechanism and a state in which the driving force is not transmitted to the driven mechanism. The carriage has a reciprocatingly movable range that includes a dot formation area in which a dot is formed on the recording surface of the recording material by the recording head and a recording head maintenance area which is disposed adjacent to the dot formation area. The driving force transmission changeover mechanism includes a cam follower mechanism and an urging unit. Specifically, the cam follower mechanism includes a face cam member and a follower member that is supported movably in the direction of the reciprocating movement of the carriage and engaged with the carriage. After the carriage has moved the follower member toward the recording head maintenance area by opposing to an urging force by the urging unit, then the carriage moves toward the dot forming area side for spacing away from the follower member to operate. The face cam member includes a first cam groove, a second cam groove, a third cam groove, and a fourth cam groove with which a protruding portion of the follower member is in sliding contact and engaged. When the carriage moves toward the recording head maintenance area side, the protruding portion is engaged, in sequence, with the first cam groove, the second cam groove, the third cam groove, and the fourth cam groove. On the dot formation area side of the first cam groove, a first lock portion with which the protruding portion is engaged by the urging force is formed. A second lock portion with which the protruding portion is engaged by the urging force is formed between the first cam groove and the second cam groove. A first guide wall that restrains the protruding portion from advancing from the third cam groove into the second cam groove is formed between the third cam groove and the second cam groove. The third cam groove is guided by a fifth cam groove to the first cam groove. A second guide wall that restrains the protruding portion from advancing from the fourth cam groove into the third cam groove is formed between the fourth cam groove and the third cam groove. The fourth cam groove is guided by a sixth cam groove to the second cam groove. When the carriage moves toward the dot formation area side, the protruding portion engaged with the third cam groove is guided into the first cam groove and the protruding portion engaged with the fourth cam groove is guided into the second cam groove. Then, with the state that the protruding portion of the follower member locked in the first lock portion, the driving force of the driving force source is transmitted to the driven mechanism. With the state that the protruding portion of the follower member locked in the second lock portion, the driving force of the driving force source is not transmitted to the driven mechanism.

As described earlier, because the driving force transmission changeover mechanism is disposed in the area near the boundary between the dot formation area and the recording head maintenance area, the recording apparatus can be reduced in size as compared with the known recording apparatuses. On the other hand, incorporating the arrangement in which the carriage and the driving force transmission changeover mechanism engage at a position near the boundary between the dot formation area and the recording head maintenance area, involves a temporary movement of the carriage from the dot formation area to the recording head maintenance area at a timing of the maintenance operation of the recording head performed at the intervals between dot formation control sequences. This gives rise to a likelihood that unnecessary drive ON/OFF changeovers will occur at this time.

The driving force transmission changeover mechanism is operated when the follower member is pushed toward the recording head maintenance area side using the carriage by opposing the urging force of the urging unit and then the carriage is moved toward the dot formation area side to be spaced away from the follower member.

When the protruding portion of the follower member is locked at the first lock portion, a state is established in which the driving force of the driving force source is transmitted to the driven mechanism (hereinafter referred to as a "drive ON-state"). When the protruding portion of the follower member is locked at the second lock portion, on the other hand, a state is established in which the driving force of the driving force source is not transmitted to the driven mechanism (hereinafter referred to as a "drive OFF-state"). The carriage is therefore moved toward the recording head maintenance area side until the protruding portion of the follower member locked at the first lock portion of the first cam groove enters the second cam groove, and the carriage is then moved toward the dot formation area side. This results in the protruding portion of the follower member being locked at the second lock portion, so that the drive ON-state can be shifted to the drive OFF-state.

Additionally, the carriage is moved toward the recording head maintenance area side until the protruding portion of the follower member locked at the second lock portion (in the drive OFF-state) enters the third cam groove and the carriage is then moved toward the dot formation area side. The protruding portion of the follower member is whereby moved by the urging force of the urging unit and guided by the first guide wall from the third cam groove to the fifth cam groove. The protruding portion of the follower member is then guided by the fifth cam groove into the first cam groove to reach the first lock portion, thus brought into the state of being locked at the first lock portion (drive ON-state). Specifically, the drive OFF-state can be shifted to the drive ON-state.

In addition, the carriage is moved toward the recording head maintenance area side until the protruding portion of the follower member in the state of being locked at the first lock portion (drive ON-state) advances from the first cam groove into the second cam groove and then to the third cam groove, and then the carriage is moved toward the dot formation area side. The protruding portion of the follower member is whereby moved by the urging force of the urging unit and guided by the first guide wall from the third cam groove to the fifth cam groove. The protruding portion of the follower member is then guided by the fifth cam groove into the first cam groove to reach again the first lock portion, thus brought into the state of being locked at the first lock portion (drive ON-state). Specifically, the drive ON-state is maintained before and after the operation.

In addition, the carriage is moved toward the recording head maintenance area side until the protruding portion of the follower member in the state of being locked at the second lock portion (drive OFF-state) advances from the second cam groove into the third cam groove and then to the fourth cam groove, and then the carriage is moved toward the dot formation area side. The protruding portion of the follower member is whereby moved by the urging force of the urging unit and guided by the second guide wall from the fourth cam groove to the sixth cam groove. The protruding portion of the follower member is then guided by the sixth cam groove into the second cam groove to reach again the second lock portion, thus brought into the state of being locked at the second lock portion (drive OFF-state). Specifically, the drive OFF-state is maintained before and after the operation.

As such, shifting from the drive ON-state to the drive OFF-state, shifting from the drive OFF-state to the drive ON-state, maintaining the drive ON-state before and after the operation, and maintaining the drive OFF-state before and after the operation can be freely selected and accomplished only by selecting the movement control of the carriage. Specifically, the recording apparatus according to the third aspect of the invention achieves reduction in size of the recording apparatus by disposing the driving force transmission changeover mechanism at the position near the boundary between the dot formation area and the recording head maintenance area. Meanwhile, the recording apparatus according to the third aspect of the invention can freely perform the changeover control of the driving force transmission changeover mechanism during execution of recording without causing unnecessary drive ON/OFF changeovers to occur.

According to the third aspect of the invention, an effect can be achieved of reducing likelihood that, in the recording apparatus having the driving force transmission changeover mechanism that uses the carriage, the recording apparatus will become larger in size.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described with reference to the accompanying drawings.

General Configuration of Ink Jet Printer

A general configuration of an ink jet printer 50 as a "recording apparatus" according to an embodiment of the invention will be described with reference to FIG. 1.

Figure 1:
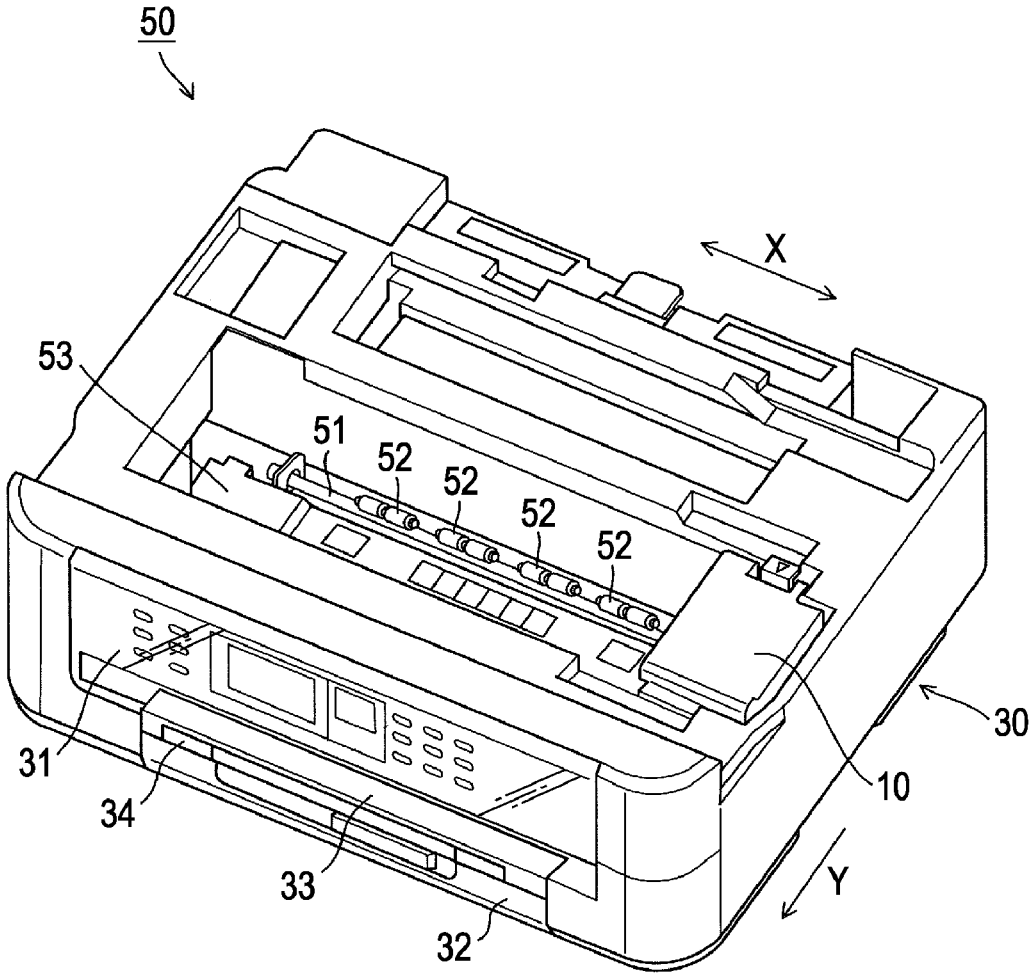
FIG. 1 is a perspective view showing an ink jet printer according to an embodiment of the invention as viewed from an upper side thereof.

FIG. 1 is a perspective view showing the ink jet printer 50 according to the embodiment of the invention as viewed from an upper side thereof.

The ink jet printer 50 has an outer casing 30. The outer casing 30 is a cabinet that forms an appearance of the ink jet printer 50. The outer casing 30 includes an operation portion 31 disposed on the side of a front surface thereof. The operation portion 31 includes, for example, a liquid crystal display, operation buttons, and the like. A paper feed cassette 32 in which recording paper as a "recording material" is loaded inside the ink jet printer 50 is disposed attachably and detachably from the front side of the ink jet printer 50. The outer casing 30 also includes a discharge port 33 disposed on the front side thereof. The recording paper on which recording has been executed is fed to the discharge port 33. A sliding stowage discharge tray 34 is disposed near the discharge port 33.

The ink jet printer 50 includes, as a method for transporting the recording paper in a sub-scanning direction Y, a transport drive roller 51 and a plurality of transport driven rollers 52 disposed therein. The transport drive roller 51 is rotated by a rotatable driving force transmitted from a transport motor not shown. The transport driven rollers 52 are supported rotatably and abut on an outer peripheral surface of the transport drive roller 51 by an urging force of, for example, a spring not shown. The recording paper is transported in the sub-scanning direction Y by rotation of the transport drive roller 51 while being pressed between the transport drive roller 51 and the transport driven rollers 52.

A platen 53 is disposed on the downstream side from the transport drive roller 51 in the sub-scanning direction Y. The platen 53 supports and slides the recording paper that is transported in the sub-scanning direction Y through the rotation of the transport drive roller 51 in a region including a dot formation area X1 in which dots are formed on a recording surface of the recording paper by a recording head (not shown).

In addition, the ink jet printer 50 includes a carriage 10 disposed thereinside. The carriage 10 is supported reciprocatingly movably in a main scanning direction X. The carriage 10 has the above-mentioned recording head disposed on a bottom portion thereof at a position at which a head surface of the recording head opposes the platen 53. A driving force transmission unit not shown, such as, for example, an endless belt, is used to transmit a driving force of a carriage motor not shown to the carriage 10, causing the carriage 10 to reciprocate in the main scanning direction X. Position control of the carriage 10 can be performed by controlling the rotation of the carriage motor based on an output signal from a well-known linear encoder (not shown). The head surface of the recording head includes a plurality of ink jet nozzles arranged therein for forming dots on the recording surface of the recording paper. The recording head is supplied with ink from an ink cartridge (not shown) disposed attachably and detachably on the carriage 10.

The recording paper in the paper feed cassette 32 is fed by a feed unit not shown to a portion at which the transport drive roller 51 and the transport driven rollers 52 abut each other. Recording on the paper being fed is carried out by executing the following operations alternately and repeatedly: an operation of transporting the paper through the platen 53 in the sub-scanning direction Y by the rotation of the transport drive roller 51; and an operation of forming dots on the recording surface by the ink jetted from the recording head that reciprocates in the main scanning direction X. Following the recording execution, the recording paper is fed and discharged via the discharge port 33 by a discharge unit that may include such parts as, for example, a discharge roller not shown. Feed or transport control of the recording paper, position control of the carriage 10, control of ink jet from the recording head, and the like are performed by a control unit that may include such parts as, for example, a microprocessor control circuit not shown.

The general configuration of the ink jet printer 50 will further be described with reference to FIG. 2.

Figure 2:
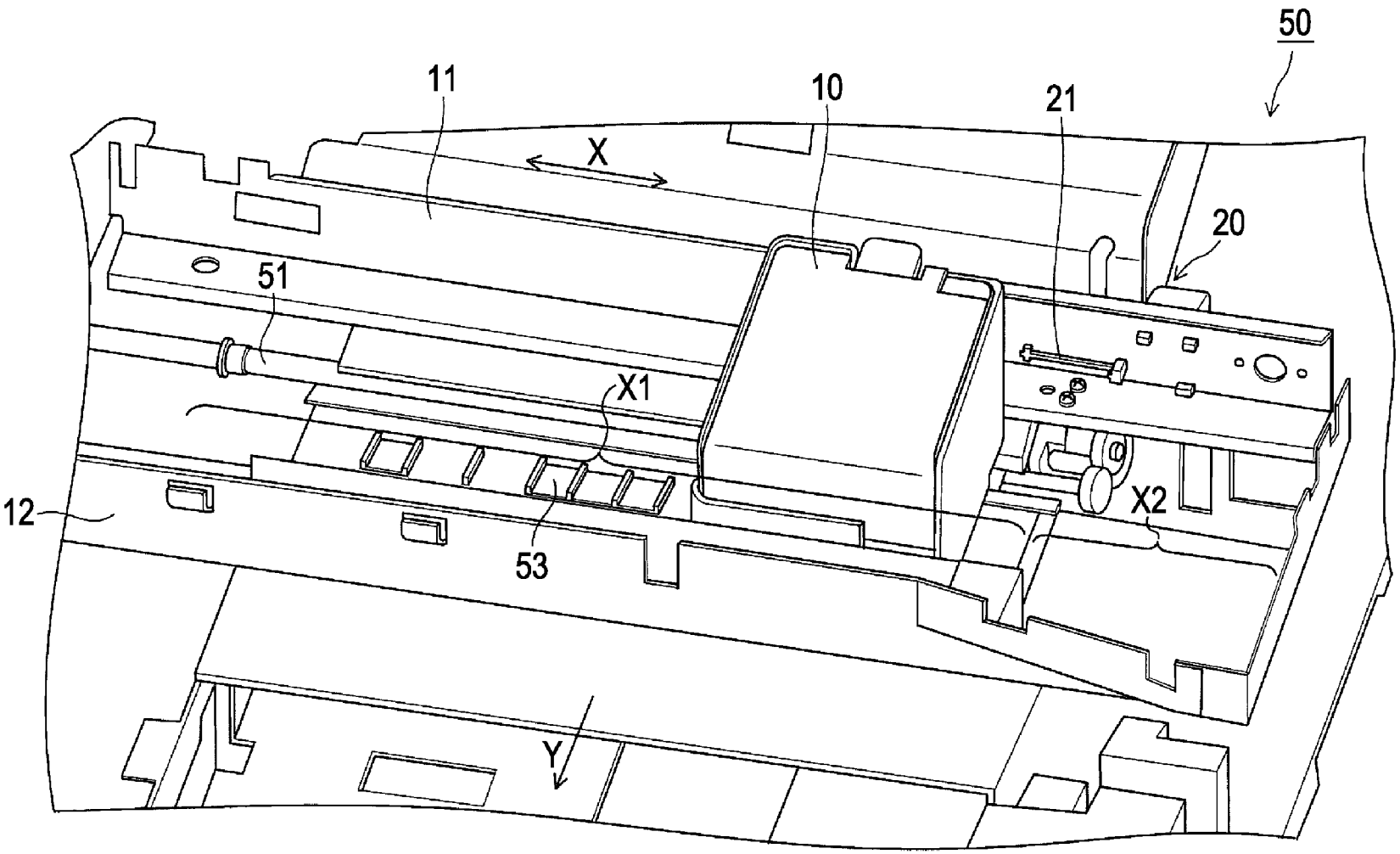
FIG. 2 is an enlarged perspective view showing part of the ink jet printer according to the embodiment of the invention.

FIG. 2 is an enlarged perspective view showing part of the ink jet printer 50 according to the embodiment of the invention.

The carriage 10 is supported reciprocatingly movably in the main scanning direction X by a first support frame 11 and a second support frame 12. The movable range of the carriage 10 includes the dot formation area X1 and a recording head maintenance area X2. The carriage 10 is reciprocatingly moved in the main scanning direction X across the dot formation area X1, during which ink is jetted from the head surface of the recording head to form dots on the recording surface of the recording paper. The recording head maintenance area X2 is disposed outside the dot formation area X1 and a capping unit not shown is disposed in the recording head maintenance area X2.

A well-known capping unit disposed in the recording head maintenance area X2 performs a maintenance operation for the recording head. The capping unit includes a cap, a wiper, and the like (not shown). The cap prevents the head surface of the recording head from drying in a standby state during which recording is not executed. The wiper performs a wiping operation to remove excess ink or other foreign matter from the head surface of the recording head. In addition, a flushing operation is performed at predetermined timings during the execution of the recording. The flushing operation is a sequence of operation performed during the execution of the recording, in which the carriage 10 is temporarily moved to the recording head maintenance area X2 and ink is ejected on the cap of the capping unit. A position at which the carriage 10 is stationary and the recording head can be sealed with the cap in the standby state is defined as a home position.

The ink jet printer 50 according to the embodiment of the invention further includes a driving force transmission changeover mechanism 20 disposed near a boundary between the dot formation area X1 and the recording head maintenance area X2. This configuration eliminates the need for having a space for disposing the driving force transmission changeover mechanism 20 outside the recording head maintenance area X2. In addition, the configuration makes the carriage 10 and the driving force transmission changeover mechanism 20 be engaged with each other near the boundary between the dot formation area X1 and the recording head maintenance area X2. Consequently, there is no need to extend the movable range of the carriage 10 beyond the recording head maintenance area X2. This permits reduction in size further as compared with the publicly known art.

Configuration of the Driving Force Transmission Changeover Mechanism 20

Figure 4:
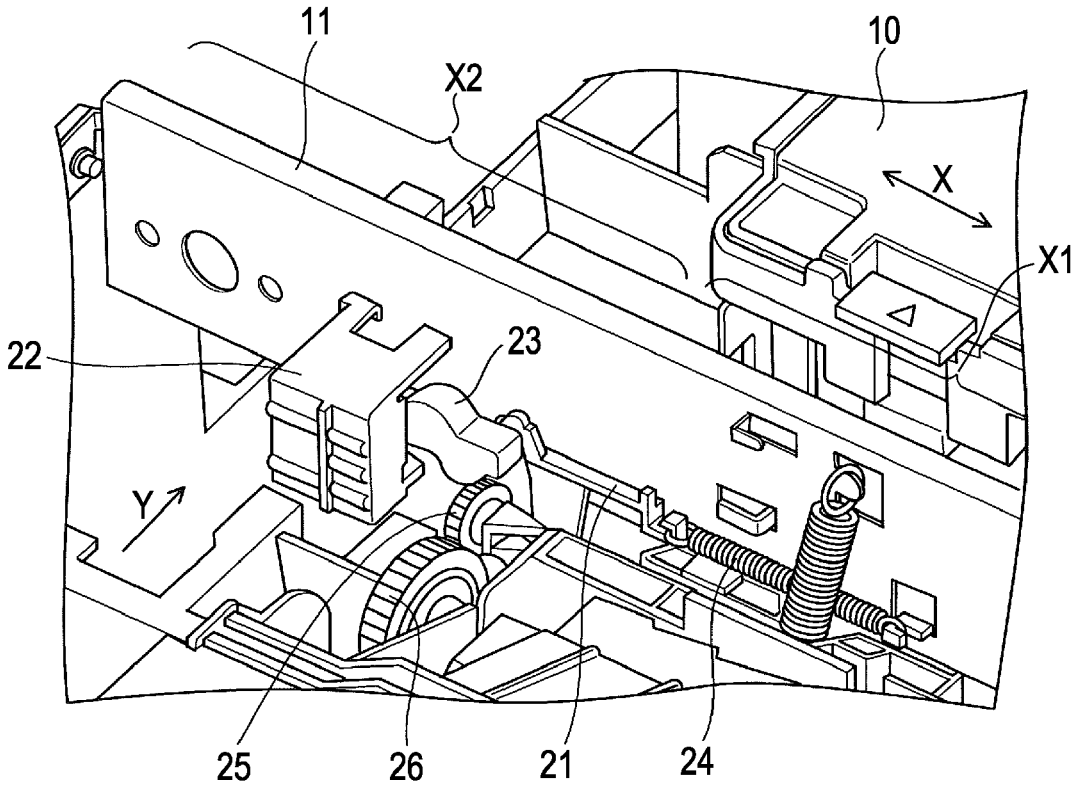
FIG. 4 is an enlarged perspective view showing an area near the driving force transmission changeover mechanism as viewed from a rear side of the ink jet printer according to the embodiment of the invention.
Figure 5:
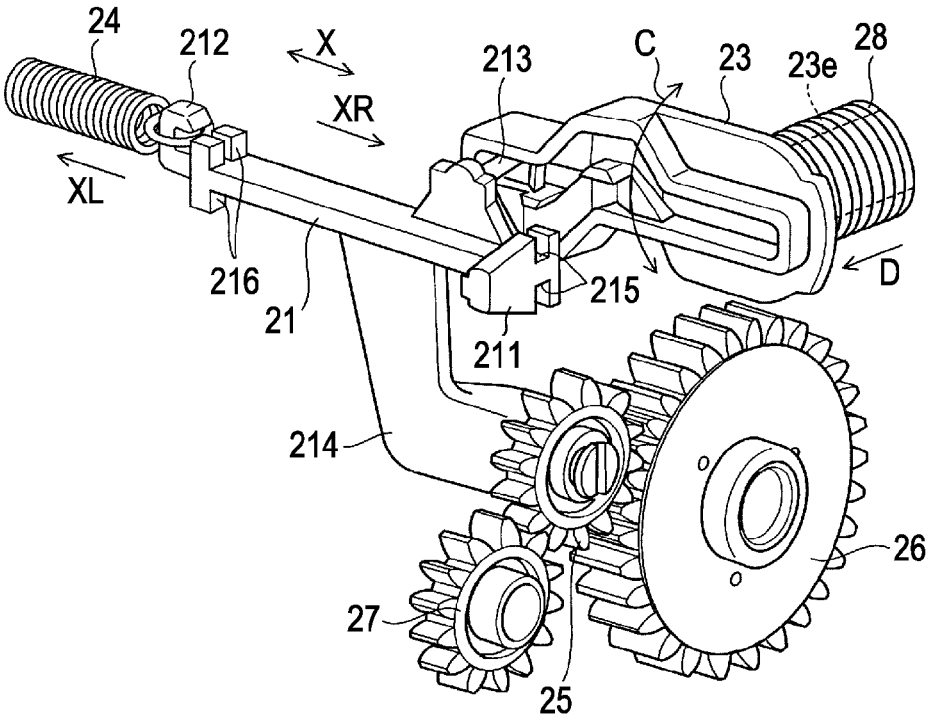
FIG. 5 is a perspective view showing an essential portion of the driving force transmission changeover mechanism.

A configuration of the driving force transmission changeover mechanism 20 will then be described with reference to FIGS. 3 to 5.

Figure 3:
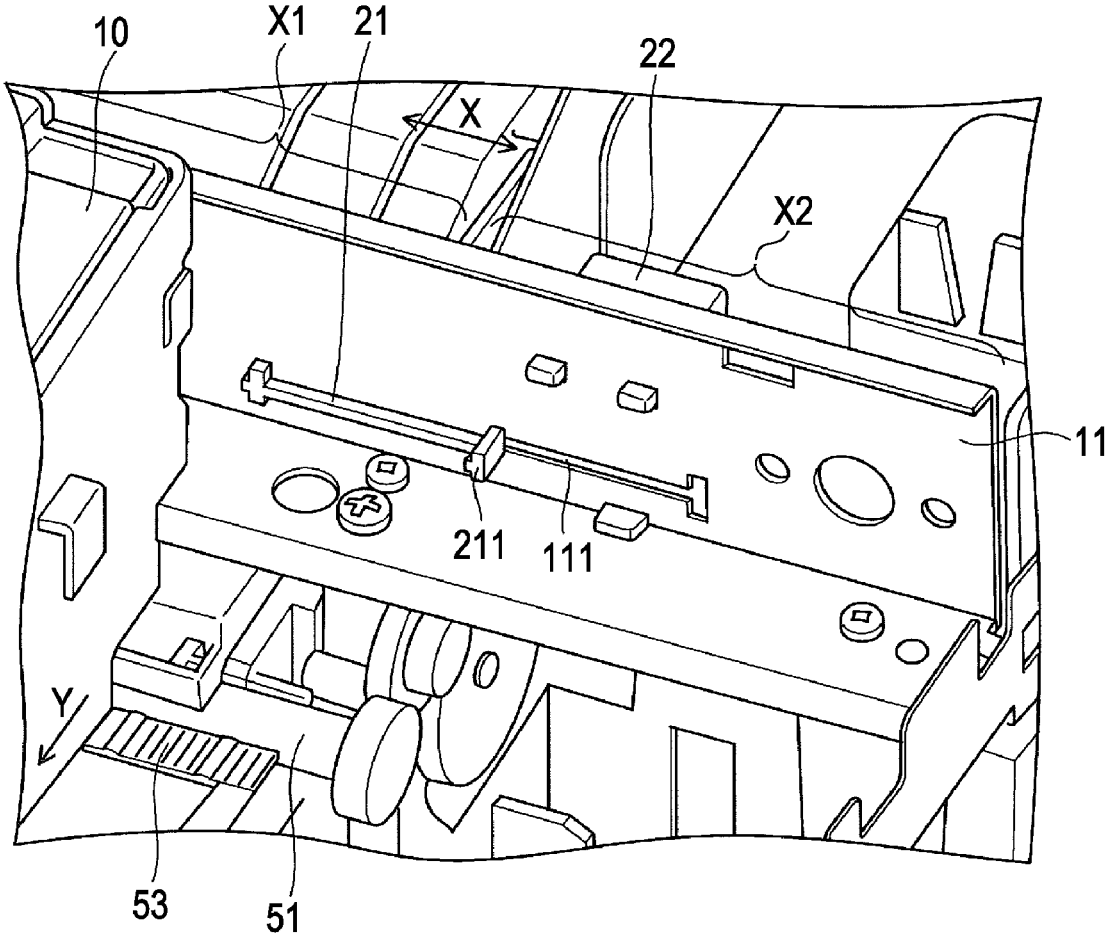
FIG. 3 is an enlarged perspective view showing an area near a driving force transmission changeover mechanism as viewed from a front side of the ink jet printer according to the embodiment of the invention.

FIG. 3 is an enlarged perspective view showing an area near the driving force transmission changeover mechanism 20 of the ink jet printer 50 as viewed from a front side of the ink jet printer 50 according to the embodiment of the invention. FIG. 4 is an enlarged perspective view showing an area near the driving force transmission changeover mechanism 20 of the ink jet printer 50 as viewed from a rear side of the ink jet printer 50 according to the embodiment of the invention. FIG. 5 is a perspective view showing an essential portion of the driving force transmission changeover mechanism 20.

The ink jet printer 50 includes the above-mentioned transport motor as a "driving force source". The transport motor is, for example, a DC motor serving as the driving force source shared between the transport drive roller 51 and the feed unit mentioned earlier. A rotatable driving force of the transport motor can be transmitted to the transport drive roller 51 at all times. On the other hand, the rotatable driving force is transmitted to the feed unit via the driving force transmission changeover mechanism 20. The driving force transmission changeover mechanism 20 can switch to a mode in which the rotatable driving force of the transport motor is transmitted to the feed unit as a "driven mechanism" or to a mode in which the rotatable driving force of the transport motor is not transmitted. The driving force transmission changeover mechanism 20 becomes operative when the carriage 10 is engaged therewith.

The driving force transmission changeover mechanism 20 has a cam follower mechanism including a follower member 21 and a face cam member 23. The driving force transmission changeover mechanism 20 further includes a support member 22 of the face cam member 23 (hereinafter referred to as a "cam support member 22"), a first coil spring 24, a first gear 25, a second gear 26, a third gear 27, and a second coil spring 28.

The follower member 21 is supported in a long groove 111 of the first support frame 11 movably in the main scanning direction X. More specifically, the follower member 21 is supported movably in the main scanning direction X with guide portions 215, 216 of the follower member 21 engaged in the long groove 111 of the first support frame 11. The first coil spring 24 as an "urging unit" has one end thereof hooked on a spring hook portion 212 of the follower member 21 and the other end thereof hooked on the first support frame 11. This configuration causes the follower member 21 to be urged in a forward direction XL (one way in the main scanning direction X). The follower member 21 has an operation portion 211 with which the carriage 10 is engaged when the follower member 21 is pushed by the carriage 10 in a backward direction XR (the other way in the main scanning direction X). The follower member 21 further includes a protruding portion 213 (hereinafter referred to as a "follower protruding portion 213") with which a cam groove (to be described later) of the face cam member 23 is engaged.

The cam support member 22 is supported by the first support frame 11. The face cam member 23 is disposed near the boundary between the dot formation area X1 and the recording head maintenance area X2 and is supported by the cam support member 22 swingably in a direction indicated by a reference symbol C based on a shaft 23*e* that intersects the main scanning direction X. The second coil spring 28 is pushed and fixed through-around the shaft 23*e* of the face cam member 23, applying an urging force to the face cam member 23 in a direction indicated by a reference symbol D so as to urge the face cam member 23 to the follower member 21.

The first gear 25 is rotatably supported by an arm portion 214 of the follower member 21. The second gear 26 transmits a rotatable driving force to the feed unit. The rotatable driving force of the transport motor is transmitted to the third gear 27 at all times. When the first gear 25 is in mesh both with the second gear 26 and the third gear 27 therebetween, the rotatable driving force of the transport motor is transmitted to the feed unit. When the follower member 21 moves in the backward direction XR from this situation, the first gear 25 is set to be not in mesh with the second gear 26 or the third gear 27, whereby the rotatable driving force of the transport motor is not transmitted to the feed unit.

Structure of the Face Cam Member 23

The structure of the face cam member 23 will then be described with reference to FIGS. 6, 7A, 7B, and 7C.

Figure 6:
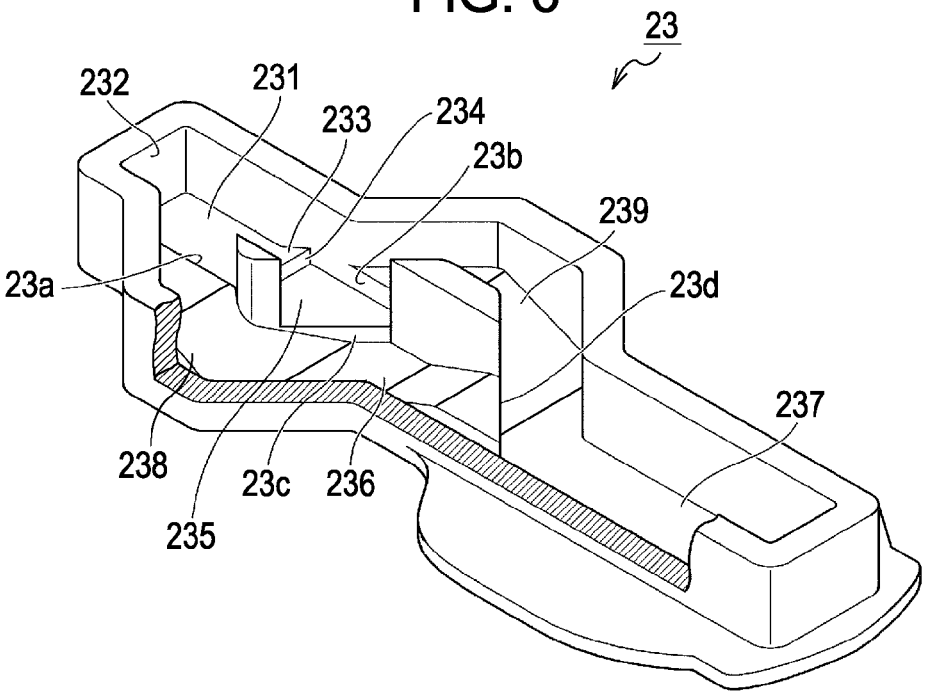
FIG. 6 is a partly cutaway perspective view showing a face cam member.

FIG. 6 is a partly cutaway perspective view showing the face cam member 23.

Figure 7A:
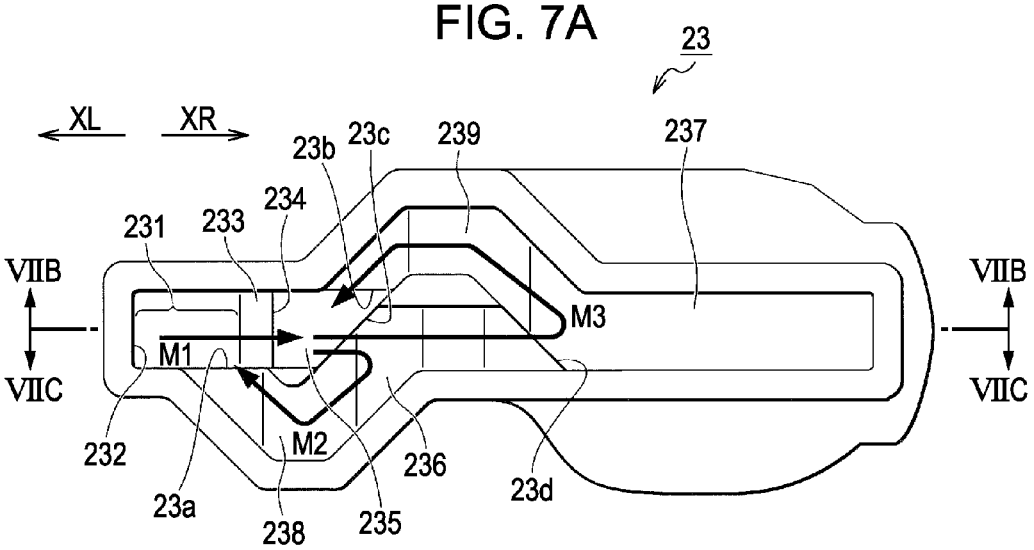
FIGS. 7A, 7B, and 7C are a plan view and cross-sectional views, respectively, showing the face cam member.
Figure 7B:
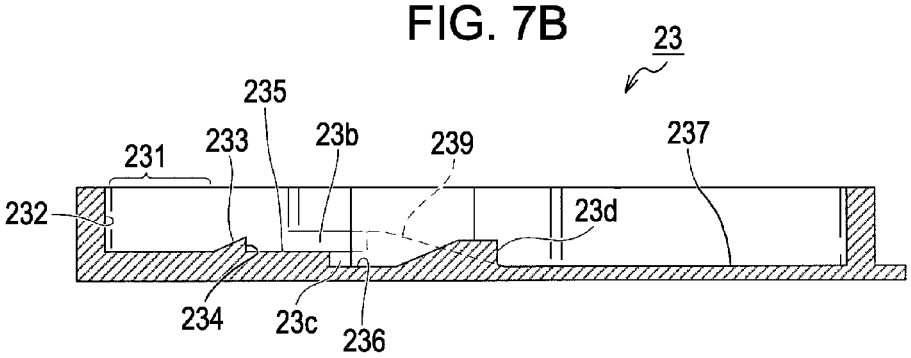
Figure 7C:
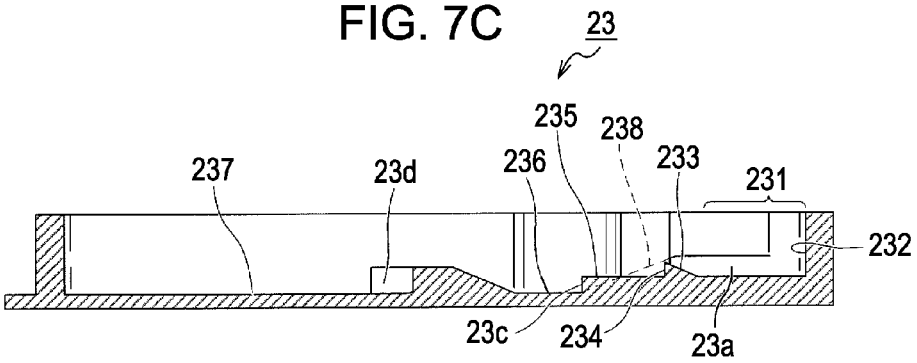

FIGS. 7A, 7B, and 7C are a plan view and cross-sectional views, respectively, showing the face cam member 23. FIG. 7A is a plan view showing the face cam member 23. FIG. 7B is a cross-sectional view showing the face cam member 23 taken along a line VIIB-VIIB. FIG. 7C is a cross-sectional view showing the face cam member 23 taken along a line VIIC-VIIC.

The face cam member 23 includes, as cam grooves with which the follower protruding portion 213 makes sliding contact and engages, a first cam groove 231, a second cam groove 235, a third cam groove 236, a fourth cam groove 237, a fifth cam groove 238, and a sixth cam groove 239.

The first cam groove 231 includes a first lock portion 232 formed at an end portion on the side of the dot formation area X1. A second lock portion 234 is formed between the first cam groove 231 and the second cam groove 235. In addition, the first cam groove 231 includes a slope 233 extending upward from a bottom surface of the first cam groove 231 to an upper end of the second lock portion 234. A guide wall 23*c* (first guide wall) is formed between the third cam groove 236 and the second cam groove 235. The guide wall 23*c* restrains the follower protruding portion 213 from advancing from the third cam groove 236 into the second cam groove 235. A guide wall 23*d* (second guide wall) is formed between the fourth cam groove 237 and the third cam groove 236. The guide wall 23*d* restrains the follower protruding portion 213 from advancing from the fourth cam groove 237 into the third cam groove 236.

The fifth cam groove 238 is formed from the third cam groove 236 up to the first cam groove 231 by bypassing the second lock portion 234. The sixth cam groove 239 is formed from the fourth cam groove 237 up to the second cam groove 235 by bypassing the third cam groove 236. A step 23*a* is formed at a boundary between the fifth cam groove 238 and the first cam groove 231. The step 23*a* guides the follower protruding portion 213 that is moving in the backward direction XR to the second cam groove 235 so as not to allow the follower protruding portion 213 to advance from the first cam groove 231 into the fifth cam groove 238. A step 23*b* is formed at a boundary between the sixth cam groove 239 and the second cam groove 235. The step 23*b* guides the follower protruding portion 213 that is moving from the second cam groove 235 in the backward direction XR to the third cam groove 236 so as not to allow the follower protruding portion 213 to advance into the sixth cam groove 239.

Operation of the Driving Force Transmission Changeover Mechanism 20

Operation of the driving force transmission changeover mechanism 20 will be described with reference to FIGS. 8A and 8B through 11, in addition to FIGS. 6, 7A, 7B, and 7C.

The driving force transmission changeover mechanism 20 is operated when the carriage 10 pushes the follower member 21 in the backward direction XR (toward the side of the recording head maintenance area) opposing to a spring force of the first coil spring 24 and then moves in the forward direction XL (toward the side of the dot formation area) to be spaced away from the follower member 21. The driving force transmission changeover mechanism 20 selects any one of a plurality of operation modes according to a specific position to which the follower member 21 is pushed in the backward direction XR when the carriage 10 pushes the follower member 21 in the backward direction XR.

Figure 8A:
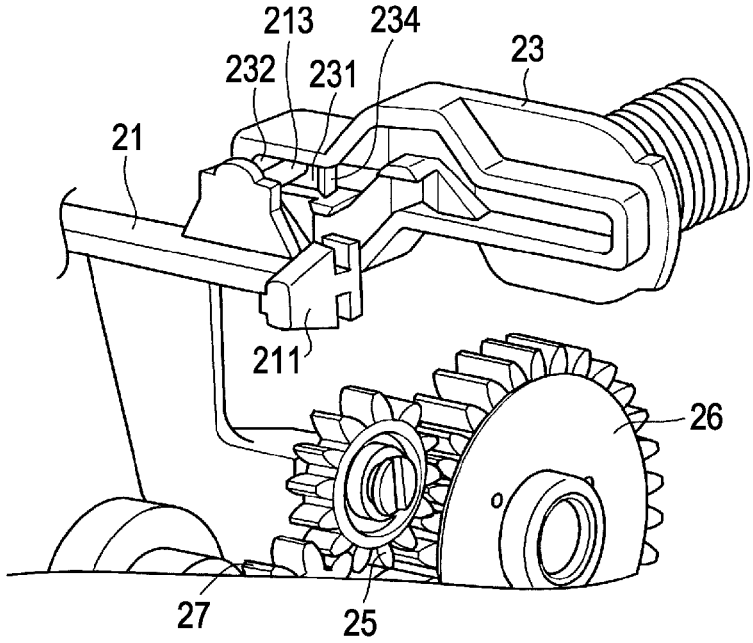
FIGS. 8A and 8B are perspective views showing an essential portion of the driving force transmission changeover mechanism operative in a first changeover operation mode.
Figure 8B:
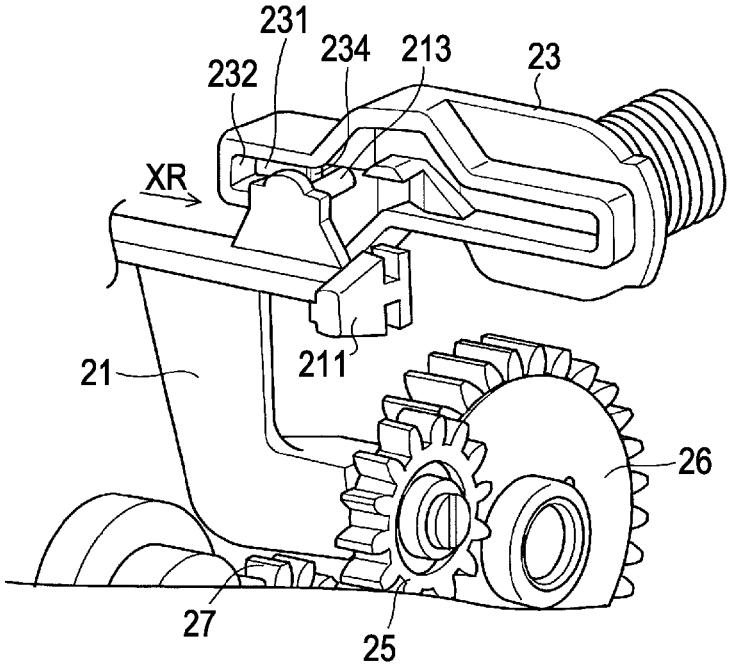

FIGS. 8A and 8B are perspective views showing an essential portion of the driving force transmission changeover mechanism 20 operative in a first changeover operation mode. Operation of the driving force transmission changeover mechanism 20 in the first changeover operation mode will be described below.

When the follower protruding portion 213 is locked at the first lock portion 232 of the face cam member 23, the first gear 25 is in mesh with the second gear 26 and the third gear 27. A drive ON-state is established in this condition, and the rotatable driving force of the transport motor is transmitted to the feed unit (FIG. 8A).

The carriage 10 is then used in this condition to push the follower member 21 in the backward direction XR. The follower protruding portion 213 advances along the first cam groove 231 in the backward direction XR, goes over the slope 233 to move past the second lock portion 234, and advances along the second cam groove 235 in the backward direction XR. The carriage 10 is stopped just before the follower protruding portion 213 goes into the third cam groove 236 after having moved past the second lock portion 234. The carriage 10 is then moved in the forward direction XL. The follower protruding portion 213 is advanced along the second cam groove 235 in the forward direction XL by the spring force of the first coil spring 24 and brought into a locked state at the second lock portion 234 (reference symbol M1 in FIG. 7A). In this condition, because the first gear 25 is not in mesh with the second gear 26 or the third gear 27, a drive OFF-state is established in which the rotatable driving force of the transport motor is not transmitted to the feed unit (FIG. 8B).

That is, the first changeover operation mode is an operation mode in which transmission of the driving force changes from the drive ON-state to the drive OFF-state. For example, if the driving force transmission changeover mechanism 20 is in the drive ON-state during execution of recording on the recording paper, the feed unit is activated to operate when the transport motor starts to rotates, so that another sheet of recording paper is fed during the execution of recording on the foregoing sheet of recording paper. As a result, duplicate feed of recording paper occurs. The operation in the first changeover operation mode is therefore ought to be performed, after a sheet of recording paper is fed and before the recording is initiated on the particular sheet of recording paper. This allows the state of transmission of the driving force to the feed unit in the driving force transmission changeover mechanism 20 to change from the drive ON-state to the drive OFF-state, thus properly avoiding duplicate feed of the recording paper as described above.

Figure 9A:
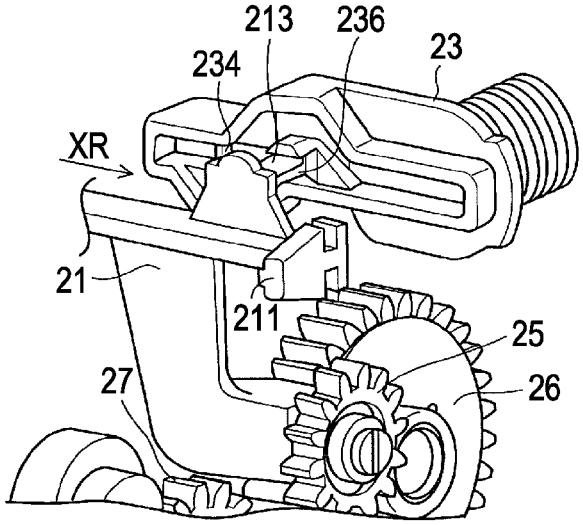
FIGS. 9A, 9B, and 9C are perspective views showing the essential portion of the driving force transmission changeover mechanism operative in a second changeover operation mode.
Figure 9B:
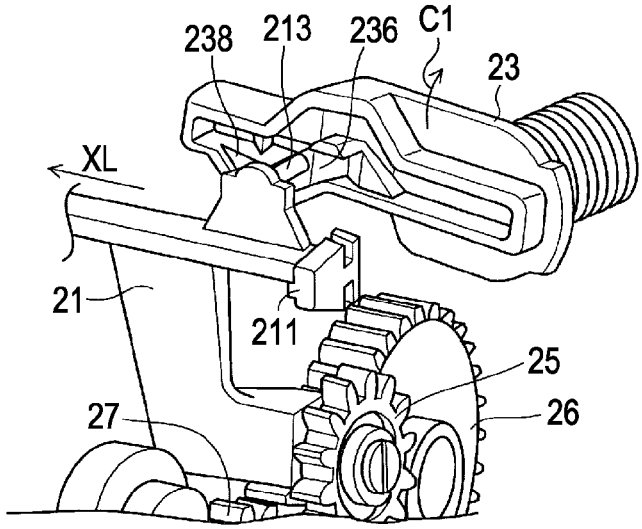
Figure 9C:
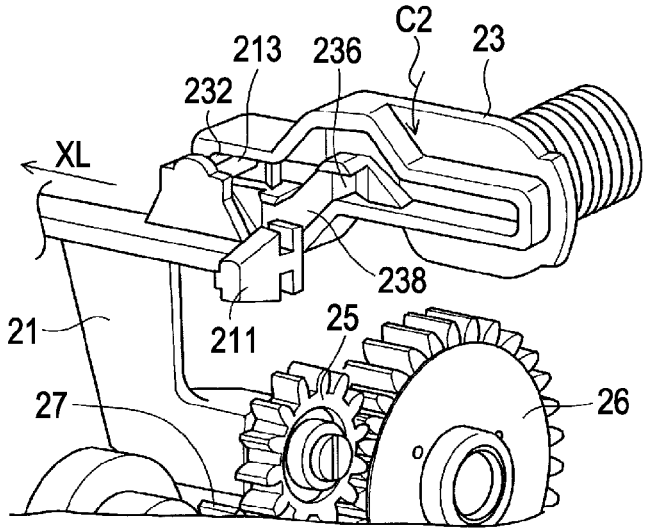

FIGS. 9A, 9B, and 9C are perspective views showing the essential portion of the driving force transmission changeover mechanism 20 operative in a second changeover operation mode. Operation of the driving force transmission changeover mechanism 20 in the second changeover operation mode will be described below.

In the condition that the follower protruding portion 213 is locked at the second lock portion 234 of the face cam member 23 (the drive OFF-state), the carriage 10 pushes the follower member 21 in the backward direction XR. The follower protruding portion 213 advances along the second cam groove 235 in the backward direction XR into the third cam groove 236 (FIG. 9A). The carriage 10 is stopped just before the follower protruding portion 213 enters the fourth cam groove 237 and then is moved in the forward direction XL. The follower protruding portion 213 is then advanced in the forward direction XL by the spring force of the first coil spring 24. At this time, the follower protruding portion 213 is guided by the guide wall 23*c* from the third cam groove 236 to the fifth cam groove 238; accordingly, the face cam member 23 swings in a direction shown by a reference symbol C1 (FIG. 9B). By advancing through the fifth cam groove 238, the follower protruding portion 213 bypasses the second lock portion 234 and advances into the first cam groove 231; accordingly, the face cam member 23 swings in a direction shown by a reference symbol C2. The follower protruding portion 213 is then locked at the first lock portion 232, thereby establishing the drive ON-state (FIG. 9C).

Specifically, the second changeover operation mode is an operation mode in which transmission of the driving force changes from the drive OFF-state to the drive ON-state caused by the operation of the carriage. For example, in order to feed the recording paper, the operation in the second changeover operation mode is to be performed. This allows the state of transmission of the driving force to the feed unit in the driving force transmission changeover mechanism 20 to change from the drive OFF-state to the drive ON-state, so that the feed unit is operated by the rotatable driving force of the transport motor to feed the recording paper.

If the operations in the first changeover operation mode and the second changeover operation mode are continuously performed, an operation mode for maintaining the drive ON-state of the driving force transmission can be achieved even when the driving force transmission changeover mechanism 20 is operated by the movement of the carriage 10.

Figure 10A:
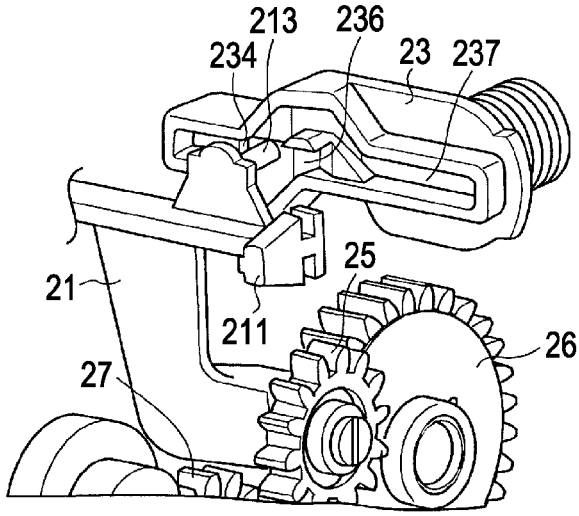
FIGS. 10A, 10B, and 10C are perspective views showing the essential portion of the driving force transmission changeover mechanism operative in a maintenance operation mode.
Figure 10B:
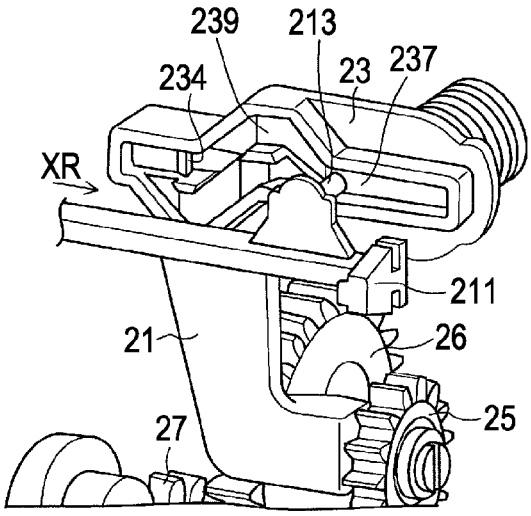
Figure 10C:
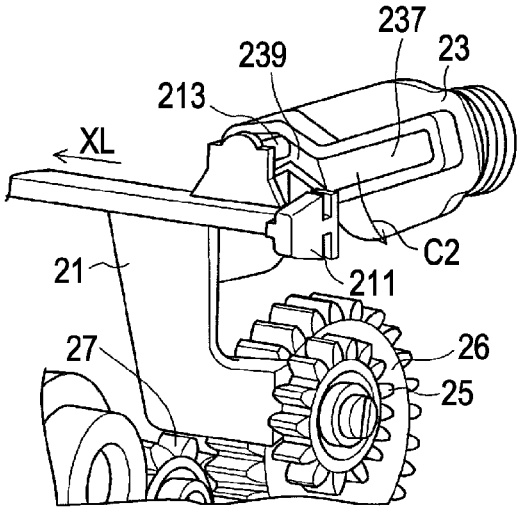

FIGS. 10A, 10B, and 10C are perspective views showing the essential portion of the driving force transmission changeover mechanism 20 operative in a maintenance operation mode. Operation of the driving force transmission changeover mechanism 20 in the maintenance operation mode will be described below.

In the condition that the follower protruding portion 213 is locked at the second lock portion 234 of the face cam member 23 (the drive OFF-state), the carriage 10 pushes the follower member 21 in the backward direction XR (FIG. 10A). The follower protruding portion 213 advances along the second cam groove 235 in the backward direction XR and moves past the third cam groove 236 into the fourth cam groove 237 (FIG. 10B). The carriage 10 is stopped after the follower protruding portion 213 enters the fourth cam groove 237 and then is moved in the forward direction XL. The follower protruding portion 213 is then advanced in the forward direction XL by the spring force of the first coil spring 24. At this time, the follower protruding portion 213 is guided by the guide wall 23*d* from the fourth cam groove 237 to the sixth cam groove 239; accordingly, the face cam member 23 swings in a direction shown by a reference symbol C2 (FIG. 10C). By advancing through the sixth cam groove 239, the follower protruding portion 213 bypasses the third cam groove 236 and goes into the second cam groove 235 again. Accordingly, the follower protruding portion 213 is locked again at the second lock portion 234 and the drive OFF-state is maintained (FIG. 10A).

That is, the maintenance operation mode is an operation mode in which the drive OFF-state of the driving force transmission is maintained even if the carriage 10 is operated. For example, if a flushing operation, a wiping operation, or a related operation is to be performed by temporarily moving the recording head to the recording head maintenance area X2 during execution of recording, the driving force transmission changeover mechanism 20 is operated at all times. Accordingly, when the flushing operation, the wiping operation, or the related operation is to be performed during the execution of recording, movement control of the carriage 10 is to be performed so that the driving force transmission changeover mechanism 20 is operated in the maintenance operation mode. Specifically, before or after, or during the flushing operation, the wiping operation, or the related operation, the carriage 10 should be moved until the follower protruding portion 213 of the follower member 21 enters the fourth cam groove 237 of the face cam member 23. The drive OFF-state of the driving force transmission can be maintained before and after the operation in the maintenance operation mode. Consequently, a condition can be avoided in which the drive ON-state of the driving force transmission to the feed unit is established when the flushing operation, the wiping operation, or the related operation is performed during the execution of recording, i.e., unnecessary drive ON/OFF changeovers are restrained.

Figure 11:
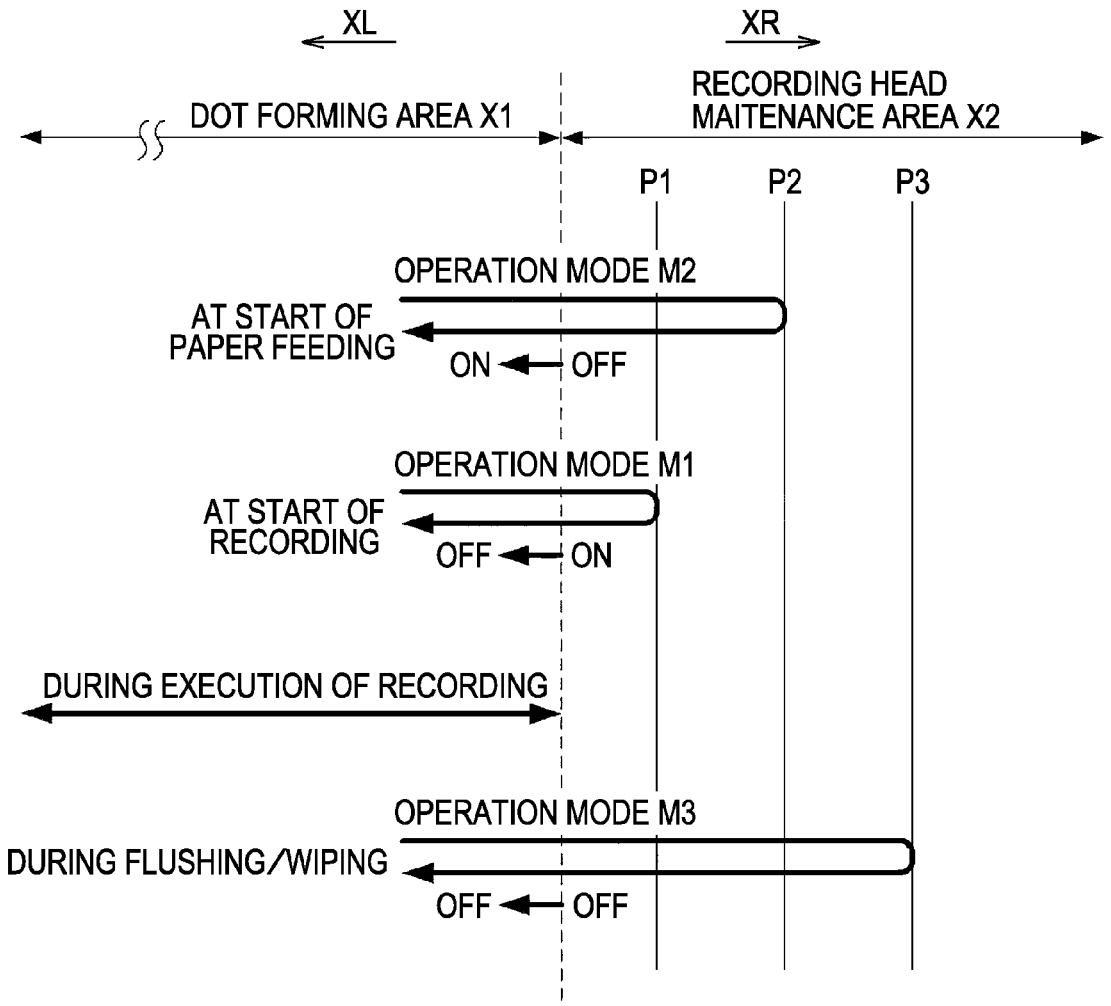
FIG. 11 is a diagram illustrating schematically operation modes.

FIG. 11 is a diagram illustrating schematically the operation modes.

When a recording paper feeding operation is initiated, the operation in the second changeover operation mode is performed to establish a condition in which the rotatable driving force of the transport motor is transmitted to the feed unit (the drive OFF-state→the drive ON-state). More specifically, the carriage 10 is first moved from the dot formation area X1 to a changeover position P2 (a first changeover position) in the recording head maintenance area X2 and then moved to the dot formation area X1. The changeover position P2 can be set at any position within a range where the follower protruding portion 213 is placed in the third cam groove 236.

When recording is executed on the recording paper, following the feeding of the recording paper, the operation in the first changeover operation mode is performed before the start of the recording so as to establish a condition in which the rotatable driving force of the transport motor is not transmitted to the feed unit (the drive ON-state→the drive OFF-state). More specifically, the carriage 10 is first moved from the dot formation area X1 to a changeover position P1 in the recording head maintenance area X2 and then moved to the dot formation area X1. The changeover position P1 can be set at any position within a range where the follower protruding portion 213 is placed in the second cam groove 235.

When the flushing operation or the wiping operation is performed at the intervals between recording sequences, the operation in the maintenance operation mode is performed, so that a condition is maintained in which the rotatable driving force of the transport motor is not transmitted to the feed unit even after the operation (the drive OFF-state→the drive OFF-state). More specifically, the carriage 10 is first moved from the dot formation area X1 to a changeover position P3 (a second changeover position) in the recording head maintenance area X2 and then moved to the dot formation area X1. The changeover position P3 can be set at any position within a range where the follower protruding portion 213 is placed in the fourth cam groove 237.

As described above, when the driving force transmission changeover mechanism 20 is to be operated, the first changeover operation mode, the second changeover operation mode, or the maintenance operation mode can be selected according to the position at which the carriage 10 turns around (i.e., the changeover position P1, P2, or P3). Consequently, the changeover control of the driving force transmission changeover mechanism 20 during execution of recording can be freely performed only through the movement control of the carriage 10 without allowing unnecessary drive ON/OFF changeovers to occur.

Specifically, the ink jet printer 50 according to the embodiment of the invention has the driving force transmission changeover mechanism 20 disposed at the position near the boundary between the dot formation area X1 and the recording head maintenance area X2, thereby achieving reduction in size of the ink jet printer 50. Further, the ink jet printer 50 according to the embodiment of the invention allows the changeover control of the driving force transmission changeover mechanism 20 during execution of recording to be freely performed without allowing unnecessary drive ON/OFF changeovers to occur. In accordance with the embodiment of the invention, therefore, the likelihood that, in the recording apparatus having the driving force transmission changeover mechanism that uses the carriage 10, the recording apparatus will become larger in size can be reduced.

Modification Examples

The invention is not limited to the above-described embodiment, but may be performed in various specific forms without departing from the sprit and scope of the invention and it is to be understood that such configurations are covered within the scope of this invention.

For example, as the "driven mechanisms" to which the driving force is transmitted via the driving force transmission changeover mechanism, an automatic PG mechanism may be used that automatically varies spacing (PG) between the head surface of the recording head and a support surface of the platen 53 by displacing a support position of the carriage. Other possible "driven mechanisms" to which the driving force is transmitted via the driving force transmission changeover mechanism may include: a pump suction changeover mechanism, a pump ON/OFF mechanism, or a plurality of pump changeover mechanisms of the capping unit; a tray transport unit that automatically transports a tray for executing recording on a label surface of an optical disc; a tray changeover mechanism that automatically selects a specific feed tray from among a plurality of feed trays according to, for example, the size of the recording paper; an automatic duplex recording unit for automatically performing duplex recording; and a rolled-paper cutting unit that automatically cuts the rolled-paper to a specified length after recording during roll forms recording.

What is claimed is:

1. A recording apparatus comprising:

a carriage that is supported reciprocatingly movably in a predetermined direction and mounted with a recording head for forming a dot on a recording surface of a recording material, the reciprocatingly movable range of the carriage includes a dot formation area in which a dot is formed on the recording surface of the recording material by the recording head and a recording head maintenance area which is disposed adjacent to the dot formation area and in which a maintenance operation of the recording head is performed; and a driving force transmission changeover mechanism engageable with the carriage, the engagement of the driving force transmission changeover mechanism and the carriage selectively transmitting a driving force of a driving force source to a driven mechanism, the driving force transmission changeover mechanism having a state in which the driving force of the driving force source is transmitted to the driven mechanism and a another state in which the driving force is not transmitted to the driven mechanism the driving force transmission changeover mechanism also having a changeover operation mode in which a state of transmission of the driving force changes and a maintenance operation mode in which the state of transmission of the driving force is maintained throughout movement of the carriage, the changeover operation mode being executed when the carriage moves from the dot formation area to a first changeover position within the recording head maintenance area and then returning to the dot formation area, and the maintenance operation mode being executed when the carriage moves from the dot formation area to a second changeover position within the recording head maintenance area and then returning to the dot formation area.

2. The recording apparatus according to claim 1, wherein:

the changeover operation mode is a mode in which the state of the driving force of the driving force source not being transmitted to the driven mechanism is changed to the state of the driving force being transmitted to the driven mechanism; and the maintenance operation mode is a mode in which the state of the driving force of the driving force source not being transmitted to the driven mechanism is maintained.

* * * * *